United States Patent [19]

Bibby et al.

[11] Patent Number: 4,834,211

[45] Date of Patent: May 30, 1989

[54] ANCHORING ELEMENT FOR IN-THE-EAR DEVICES

[76] Inventors: Kenneth Bibby, 222 Codman Rd., Norwood, Mass. 02062; Frank R. Ring, Jr., 477 East Street, Walpole, Mass. 02081

[21] Appl. No.: 151,504

[22] Filed: Feb. 2, 1988

[51] Int. Cl.[4] ..... H04R 25/02

[52] U.S. Cl. ..... 181/135; 181/130; 381/68.6; 381/69

[58] Field of Search ..... 181/130, 135; 381/68.6, 381/69, 69.2; 128/152

[56] References Cited

U.S. PATENT DOCUMENTS

| | | | |
|---|---|---|---|
| 2,535,258 | 12/1950 | Bland | 181/135 |
| 2,803,247 | 8/1957 | Zwislocki | 128/152 |
| 2,824,558 | 2/1958 | Michael et al. | 128/152 |
| 3,080,011 | 3/1963 | Henderson | 181/135 |
| 3,110,356 | 11/1963 | Mendelson | 181/130 |
| 3,197,576 | 7/1965 | Martin | 381/68.6 |
| 3,366,197 | 1/1968 | Rosenstand | 181/130 |
| 3,505,999 | 4/1970 | Harvey | 128/152 |
| 3,602,654 | 8/1971 | Victoreen | 181/135 |
| 3,783,864 | 1/1974 | Moller | 128/152 |
| 4,006,796 | 2/1977 | Coehorst | 181/130 |
| 4,133,984 | 1/1979 | Akiyama | 381/68.6 |
| 4,539,440 | 9/1985 | Sciarra | 381/68.6 X |

*Primary Examiner*—B. R. Fuller

[57] ABSTRACT

An anchoring element for a device for use in the ear canal of a wearer includes a body defining a cavity for transmission of external sound through the ear canal to the wearer and having a first portion sized and constructed to fit easily within the ear canal, an inflatable bladder removably disposed about the body and adapted for inflation by air delivered into a chamber defined by the body, to cause the bladder to inflate to resiliently engage and conform to irregularities and changes of shape of the surrounding wall of the ear canal of the wearer, e.g., during chewing. The bladder inflates in a manner to seal uniformly with the ear canal wall about the device, to hold the device firmly and securely in position in the ear canal. Pressure relief means associated with the bladder provide for venting excess air of inflation from the chamber.

10 Claims, 2 Drawing Sheets

ANCHORING ELEMENT FOR IN-THE-EAR DEVICES

This invention relates to elements for anchoring, e.g., hearing devices the ear canal.

Typically, hearing aids are custom made. A doctor or technician pours a liquid material into the ear of a user. The material is allowed to harden in the ear, then removed. The formed material is sent to a manufacturer to be cleaned, and then is used to make, via another rubber mold, the final hard plastic body. The body is hallowed out to receive the electronic parts, or a plastic tube in the case of hearing aids known as "behind the ear" or "body" aids where the amplifier is worn separately, remote from the ear canal.

In the past, hearing aids have been held somewhat in position by having a part of the device fit about some part of the outer ear. This made the aid very visible, but as this space was required for the then available electronics and battery, high visibility was inevitable. Modern technology has now reduced the volume required for the hardware, thus reducing the required size of the body, and the lack of any protrusion suited to act as a retainer for the aid in the ear is hampering the industry in its efforts to make a truly unobtrusive, well fitting aid.

It is important for such hearing devices to be close fitting to the ear canal to prevent leakage of sound past the aid, commonly referred to as feedback and identified as a high whistling noise that may be harmful to the wearer, and irritating to bystanders. Indeed, some users with very poor hearing are denied the advantages of a hearing aid because even a custom molded hard plastic body cannot maintain the required sound-proof seal.

This invention relates to an anchoring device for securely maintaining the proper location of a hearing aid or other communication device in the ear canal, regardless of the initial size or shape of the cavity, and one which will adjust itself to changes in shape of the cavity that may subsequently take place, for instance during chewing or yawning.

Representative custom molded aids, shown in FIGS. 1A, 1B, illustrate the individuality of ear canal shapes. Other hearing aids, e.g., as disclosed in Akiyama U.S. Pat. No. 4,133,984, include an inflatable envelope surrounding the portion of the hearing aid inserted into the ear canal. The envelope may be inflated with air, a liquid, or a jelly-like substance and may be inflated either prior to or after insertion into the ear canal.

SUMMARY OF THE INVENTION

According to one aspect of the invention, an anchoring element for a device for use in the ear canal of a wearer comprises a body defining a cavity for transmission of external sound through the ear canal to the wearer, the body having a first portion sized and constructed to fit easily within the ear canal, an inflatable bladder removably disposed about the first portion of the body and adapted for inflation by air delivered into a chamber defined at least in part by the bladder, via a conduit defined by the body, to cause the bladder to inflate to resiliently engage and conform to irregularities and changes of shape of the surrounding wall of the ear canal of the wearer, e.g., during chewing, in a manner to seal uniformly with the ear canal wall about the device, to hold the device firmly and securely in position in the ear canal, and pressure relief means associated with the bladder for venting excess air of inflation from the chamber.

Preferred embodiments of this aspect of the invention include one or more of the following particular features. The body is formed by molding, in a mold cavity of standard dimension and shape, and the device is fitted to irregularities of the ear canal of a wearer by means of the resilient inflatable bladder. The cavity contains means for receiving external sound and means for amplifying the sound and transmitting the sound through the ear canal to the user. The removable inflatable bladder is disposable. The cavity further contains means for powering the device. The inflatable bladder comprises first and second annular elements and a membrane extending therebetween, the annular elements sized and constructed to engage about the first portion of the body in sealing engagement, the second annular element disposed about the body at a position proximal of the first annular element, preferably, to provide the pressure relief means, at a predetermined level of pressure within the chamber, at least one the annular element is adapted to temporarily release from sealing engagement with the body to vent air from within the chamber toward outside the wearer's body. More preferably, the second annular element is adapted to temporarily release from sealing engagement with the body prior to release of the first annular element. The hearing device further comprises means for inflating the bladder, preferably the means for inflation comprises a bellows and a one-way valve for flow of air into the chamber.

According to another aspect, the invention includes, in combination, the hearing device described above and separable means for inflating the bladder.

DESCRIPTION OF THE PREFERRED EMBODIMENT

We first briefly describe the drawings.

DRAWINGS

STRUCTURE

Figure 2:
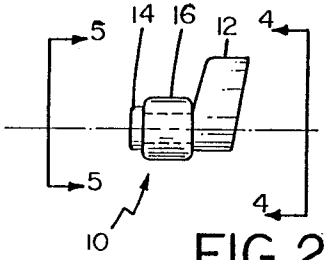
FIG. 2 is a plan view of one embodiment of an anchoring element according to the invention.

Referring to FIGS. 2 et seq., the anchoring element of the invention, constructed for use as an in-the-ear hearing aid 10, has an external portion 12 and an internal portion 14, including an inflatable bladder 16. When the hearing aid is worn, internal portion 14 is secured within the ear canal by bladder 16, while external portion 12 extends into the outer ear. Portions 12 and 14 consist primarily of an integral, injection molded plastic body 19 (e.g., nylon). External portion 12 includes a face plate 23 which encloses one end of aid 10 and, together with plastic body 19, forms a cavity 17. Cavity 17 contains conventional hearing aid microelectronics 18 and battery 20 for receiving and amplifying sound to be transmitted to the wearer via wire 21 and speaker 22 within internal portion 14. A battery door 25 in face plate 23 provides access to battery 20. Vent 30 extends through hearing aid 10 to maintain constant pressure between the inner ear and the outside.

Disposed about body 19 is inflatable bladder 16 of resilient material, e.g., rubber, consisting of a pair of seal rings 27 connected by a thin flexible membrane 29. Bladder 16 rests securely within a circumferential depression 31 in body 19, depression 31 forming a part of a bladder chamber 32 defined by bladder 16 and body 19. Bladder 16 is inflated by filling chamber 32 with air introduced via a port 26, extending through face plate 23 and partially through body 19. Chamber 32 is sealed to prevent the escape of injected air by a sleeve 28 which serves as a check valve. Both bladder 16 and sleeve 28 are removable and can be replaced by a wearer, e.g., if either component becomes soiled or worn.

USE

Figure 4:
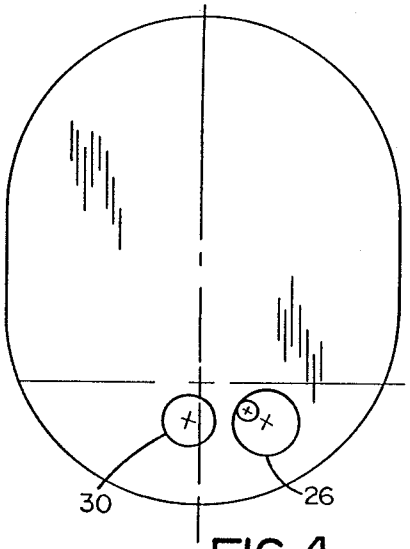
FIG. 4 is a plan view, taken along the line 4—4, of one end of the anchoring element of FIG. 2.
Figure 6:
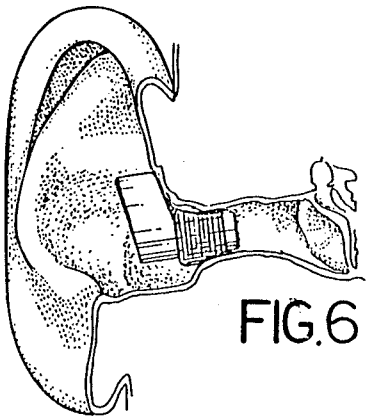
FIG. 6 is a cross-sectional view of an ear with the anchoring element of FIG. 2 inserted into the ear canal.

Referring to FIG. 6, in use, the wearer inserts internal porton 14 of device 10 into the ear canal, with bladder 16 deflated to allow internal portion 14 to fit loosely within the ear canal. External portion 12 is urged snug against the canal opening, and the wearer inflates the bladder, e.g., using a squeeze bulb 34 (FIG.3), an accessory typically used by hearing aid wearers to keep vent tubes clear (the squeeze bulb is not shown). Air is injected through part 26 into chamber 32 to inflate bladder 16 until hearing aid 10 is firmly secured within the ear canal. Over inflation of the bladder (and the possibility of injury to the wearer) is prevented by the nature of seal rings 27 (FIG. 3) which allow leakage at a certain predetermined maximum pressure from chamber 32.

The at-rest shape of bladder 16 is uniform and basically cylindrical (FIGS. 2–5), but when inflated in the ear canal flexible membrane 29 conforms itself to the irregularities of the inner wall of the canal. If constriction or expansion of the ear canal occurs, e.g., during chewing, the flexibility of the bladder allows it to change shape accordingly.

Figure 3:
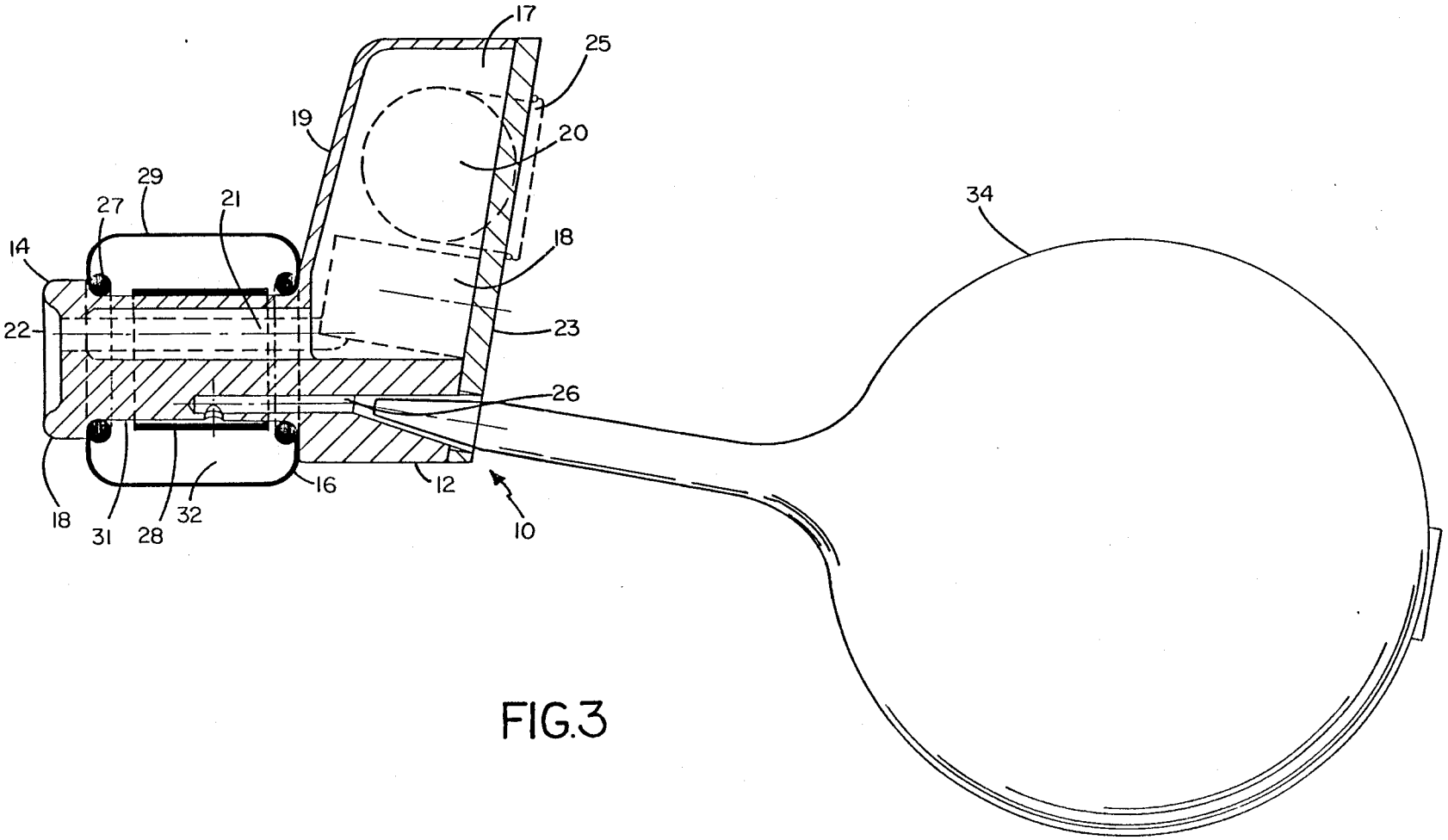
FIG. 3 is a enlarged cross-sectional view of the anchoring element of FIG. 1.

After a term of use, e.g., weekly, bladder 16 and sleeve 28 are replaced by removing the old bladder and sleeve, and pulling a new sleeve, followed by a new bladder, over the end of the body 19 until they are each properly positioned (as shown in FIG. 3) within depression 31.

MANUFACTURE

Body 19 is injection molded from hard plastic and includes, as formed, cavity 17. Holes are provided for vent 30, port 26, and speaker wire 31. Face plate 23 is stamped from a plastic sheet and includes, as stamped, holes for vent 30, port 26, and door 25. Battery 20 and microelectronics 18, with attached speaker wire 21, are attached to face plate 23, which is then glued to body 19. Speaker 21 is soldered to wire 21 and glued into place on body 19. Bladder 16 and sleeve 28, e.g., formed by rubber, are assembled with the body as described above.

By way of example only, dimensions of a typical hearing aid device of invention are as follows. The diameter of depression 31 is preferably 0.1875 inch. The diameter of the end of internal portion 14 is preferably 0.220 inch. The outside diameter of bladder 16, when inflated, is preferably 0.375 inch. The length of bladder 16 and depression 31 is preferably 0.312 inch. The length of internal portion 14 is preferably 0.362 inch. The inside diameter of the interior portion of port 26 is preferably 0.025 inch and the inside diameter of vent 30 is preferably 0.062 inch. Sleeve 28 has a maximum thickness of 0.005 inch, and membrane 29 has a maximum thickness of 0.010 inch.

Hearing aids 10 are not custom manufactured for individual wearers; instead, a single configuration of hearing aid 10 is intended to be universally adaptable to a wide variety of ear canal configurations.

Figure 7:
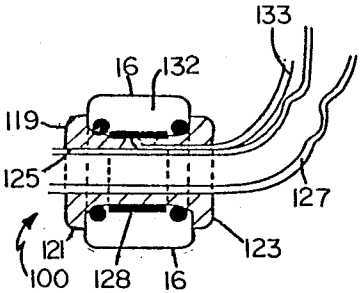
FIG. 7 is a plan view of another embodiment of an anchoring element of the invention.
Figure 1A:
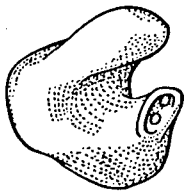
(PRIOR ART) FIG. 1A
FIGS. 1A, 1B are perspective views of representative prior art custom molded hearings aids.
Figure 1B:
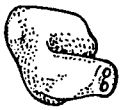
(PRIOR ART) FIG. 1B
Figure 5:
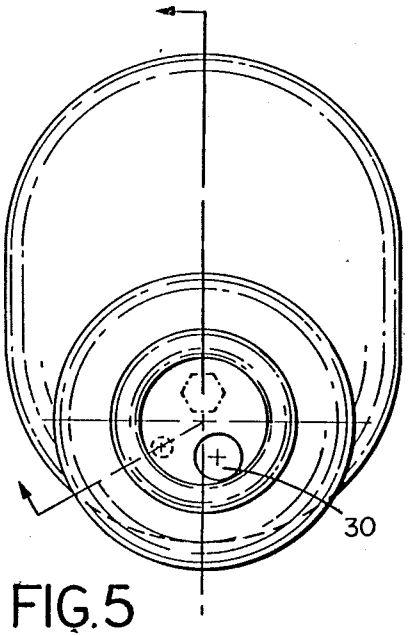
FIG. 5 is plan view, taken along the line 5—5, of another end of the anchoring element of FIG. 2.

Other embodiments are within the following claims. For example, referring to FIG. 7, an anchoring device 100 of the invention for use with an amplifier worn separately, remote from the ear, has a generally cylindrical plastic body 119 about which is disposed an inflatable bladder 16, as described above, between inner and outer annular flanges 121, 123. Inflating air is introduced into chamber 132 via hollow fiber 133 terminating beneath flap 128. Body 119 defines an axial orifice 125 through which extends a sound-carrying tube 127 from a remotely worn amplifier (not shown).

Also, other means may be provided for inflation of the bladder 16, e.g., a bellows pump may be provided within the body of the device, to be actuated by pressing upon face plate 23. Also, the anchoring device of the invention may be used with other devices, and may contain, e.g., a portion only, or none, of the hearing electrons described above, which may be provided behind the ear or in a separate, more remote, console.

What is claimed is:

1. An anchoring element for a device for use in an ear canal of a wearer, comprising:

a body, defining a cavity for transmission of sound to the wearer from a source external of the ear canal, said body having a portion sized and constructed to fit easily within the ear canal of the wearer, a replaceable, inflatable bladder removably disposed about said portion of said body and adapted for inflation by air delivered into a chamber defined at least in part by said bladder and in part by said body, by way of a conduit defined by said body, so as to resiliently and dynamically engage and conform to irregularities and changes of shape of surrounding walls of the ear canal of the wearer, so as to uniformly seal against the surrounding walls, such that said device is firmly and securely held in position in the ear canal, and pressure relief means associated with said bladder for venting excess air from said chamber.

2. The anchoring element of claim 1 wherein said body is formed by molding, in a mold cavity of standard dimension and shape, and said element is fitted to irregularities of the ear canal of a wearer by means of said resilient inflatable bladder.

3. The anchoring element of claim 1 wherein said cavity contains means for receiving sound and means for amplifying the sound and transmitting the sound through the ear canal to the wearer.

4. The anchoring element of claim 1 wherein said cavity further contains means for powering said device.

5. The anchoring element of claim 1 wherein said inflatable bladder comprises first and second annular elements and a membrane extending therebetween, said first and second annular elements engaging said portion in sealing engagement, said second annular element disposed about said body at a position proximal of said first annular element.

6. The anchoring element of claim 5 wherein, to provide said pressure relief means, at a predetermined level of pressure within said chamber, said second annular element is adapted to temporarily release from sealing engagement with said body to vent air from within said chamber proximally, away from the wearer.

7. The anchoring element of claim 6 wherein said second annular element proximal of said first annular element is adapted to temporarily release from sealing engagement with said body prior to release of said first annular element, thereby to preferentially vent air from within said chamber proximally within the ear canal.

8. The anchoring element of claim 2 further comprising means for inflating said bladder.

9. The anchoring element of claim 8 wherein said means for inflation comprises a one-way valve for flow of air into said chamber.

10. The anchoring element of any preceding claims, further comprising means, separable from said anchor element, for inflating said bladder.

* * * * *

UNITED STATES PATENT AND TRADEMARK OFFICE

CERTIFICATE OF CORRECTION

PATENT NO. : 4,834,211

DATED : May 30, 1989

INVENTOR(S) : Kenneth Bibby, et al.

It is certified that error appears in the above-identified patent and that said Letters Patent is hereby corrected as shown below:

In the Abstract, line 8, insert after "define" the following: --at least in part by the bladder, via a conduit defined--.

Col. 6, line 3, "2" should be --1--.

Col. 6, line 8, "claims" should be --claim--.

Signed and Sealed this

Tenth Day of April, 1990

*Attest:*

HARRY F. MANBECK, JR.

*Attesting Officer*

*Commissioner of Patents and Trademarks*